United States Patent [19]

Priska et al.

[11] 4,025,075

[45] May 24, 1977

[54] WILDCAT OIL WELL DRILLING GAME

[75] Inventors: Martin T. Priska, Miami; Russell V. Ringquist, Coral Gables, both of Fla.

[73] Assignees: Gustave Miller; Martin T. Priska, both of Miami; Russel V. Ringquist, Coral Gables, all of Fla.

[22] Filed: July 15, 1975

[21] Appl. No.: 596,064

[52] U.S. Cl. ..... 273/135 AB; 273/130 D; 273/135 AC; 273/135 C; 273/139

[51] Int. Cl.[2] ..... A63F 3/00

[58] Field of Search ..... 273/130 D, 134 B, 134 C, 273/134 D, 134 E, 134 AC, 134 AD, 134 AE, 134 GM, 135 AA, 135 AB, 135 AC, 135 AD, 139

[56] References Cited

UNITED STATES PATENTS

| | | | |
|---|---|---|---|
| 2,299,803 | 10/1942 | Deaton | 273/135 AB |
| 2,720,399 | 10/1955 | Pattyn | 273/134 AD |
| 2,723,857 | 11/1955 | Miller et al. | 273/134 D |
| 3,454,279 | 7/1969 | Foley et al. | 273/134 AD |
| 3,729,198 | 4/1973 | Shaffer | 273/134 C |
| 3,801,104 | 4/1974 | Potts et al. | 273/134 D |
| 3,844,567 | 10/1974 | Marker | 273/139 |

*Primary Examiner*—Anton O. Oechsle

*Assistant Examiner*—Harry G. Strappello

*Attorney, Agent, or Firm*—Gustave Miller

[57] ABSTRACT

This device is a three dimensional wildcat oil drilling game having a three dimensional game board, the surface of the game board having various identified geograhical sub areas, or sections, each sub area or section having a plurality of perforations therein, a sub stratum device mounted within the game board, beneath the game board surface, and a random stratum rotating device extending through the game board. A spinner wheel is provided for chance selection of the geographical sections. There is also provided a plurality of barrel symbols, each having a peg extending therefrom for placement in peg boards for keeping a record of the value of a player's oil holdings. Identified exploration cards are provided for indicating title rights to various wells. Three dimensional derricks are provided and cooperating therewith are oil well drills or plungers for insertion through the derricks into the section holes or perforations to contact the randomly placed sub stratum and, by means of measurement markings on the plunger, indicate the depth of the well and thus the value of the type of well. Play money in various selected denominations is provided for buying and selling in the game.

5 Claims, 15 Drawing Figures

WILDCAT OIL WELL DRILLING GAME

BACKGROUND OF THE INVENTION

Due to the energy crisis, the public has become keenly aware of oil as a source of energy, and the process of locating new oil wells, and of the risks and potential profits in oil exploration. The facilities of this game enable the players to vicariously enjoy the thrills and disappointments in oil exploration.

OBJECTS OF THE INVENTION

It is an object of this invention to provide a three dimensional game structure for playing a game of wildcatting or exploring for oil.

It is a further object of this invention to provide a three dimensional game board and three dimensional oil derricks and drills for simulating wildcat oil exploration and search for oil.

A further object of this invention is to provide a three dimensional chance controlled oil well exploration game, which, nevertheless, permits discretion and decision making on the part of the players.

Yet a further object of this invention is to provide a wildcat oil exploration game that may be played by two to six players at a time, and, if desired, could be made to accommodate an even greater number of players.

A further object of this invention is to provide an oil well exploration game wherein the game pieces and parts are three dimensional and resemble the parts actually used in actual wildcat oil exploration and drilling.

Still a further object of this invention is to enable the players to acquire as well as to lose great simulated wealth in playing this game in the same manner as real oil well drillers make and lose great actual wealth.

Yet a further object of this invention is to provide a game that is an improvement over the games shown in U.S. Pat. Nos. 3,061,313; 3,206,311; 3,815,918; and the other prior art.

BRIEF DESCRIPTION OF THE FIGURES

With the above and related objects in view, this invention consists in the details of construction and combination of parts as will be more fully understood from the following description when read in conjuction with the accompanying drawings, in which.

DETAILED DESCRIPTION OF THE INVENTION

Figure 1:
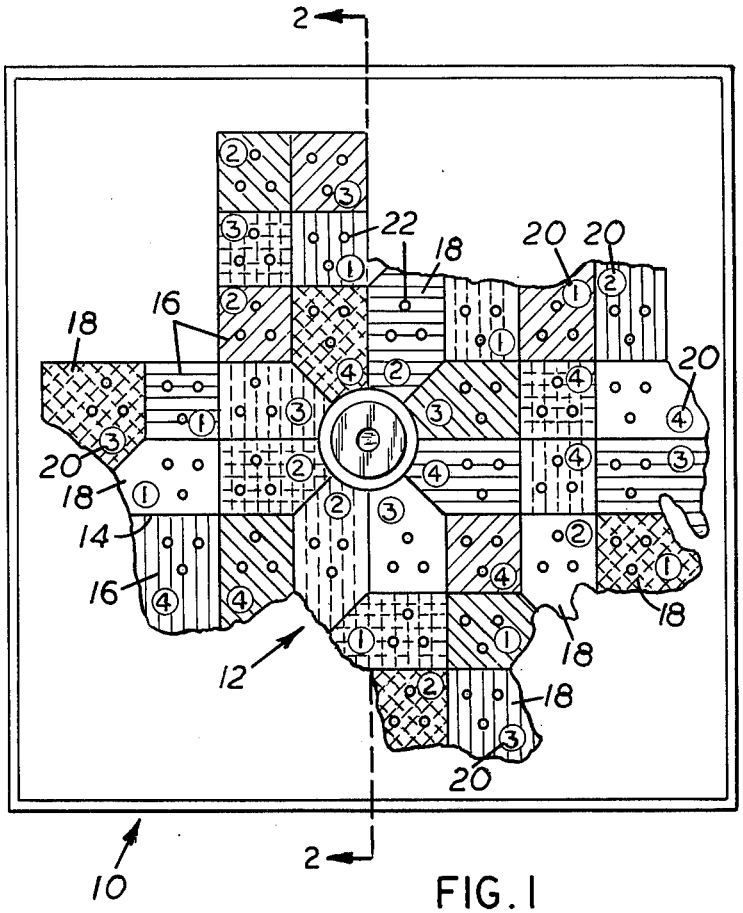
FIG. 1 is a plan view of the wildcat oil well drilling game board of this invention.
Figure 2:
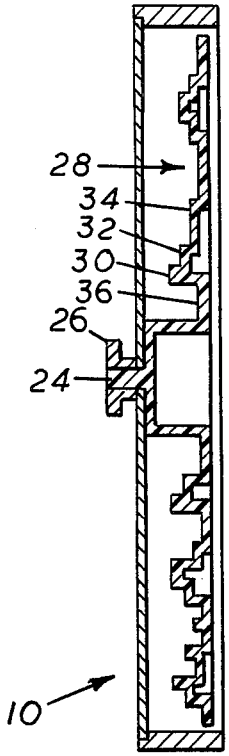
FIG. 2 is a sectional view on line 2—2 of FIG. 1.
Figure 3:
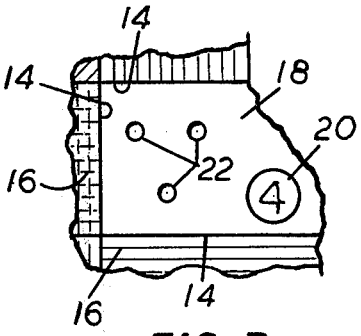
FIG. 3 is a plan view of a fragment of the board, on an enlarged scale.
Figure 5:
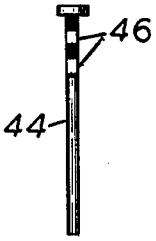
FIG. 5 is a side elevation of a well drill or plunger.
Figure 4:
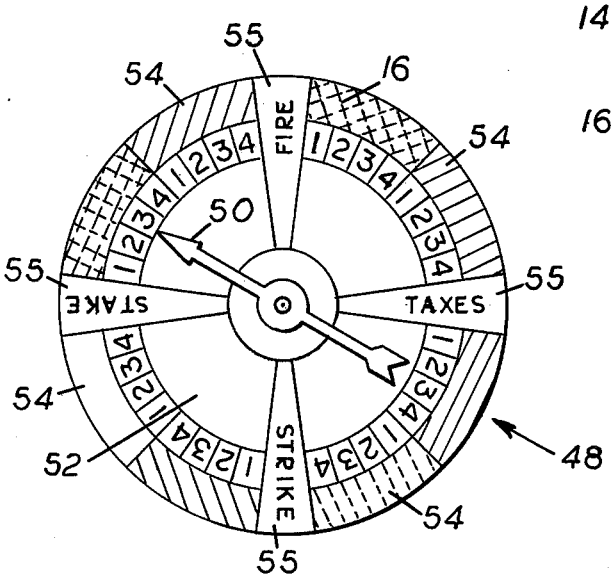
FIG. 4 is a plan view of the spinner selector wheel of this game board.
Figure 6:
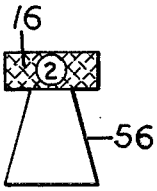
FIG. 6 is a plan view of an exploration rights card.
Figure 7:
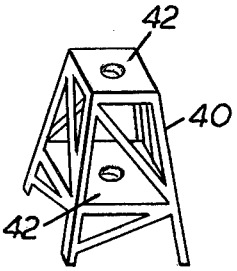
FIG. 7 is a perspective view of a derrick.

There is shown at 10 the three dimensional game board of this invention, substantially in the form of a closed box. The upper surface of the game board 10 has a geographical area 12 depicted thereon, representing an oil field area. This geographical area 12 is subdivided by a plurality of geographical section border lines 14 and differently colored surfaces 16 somewhat like a map, each section 18 having a circled identification numeral 20, from 1 to 4 thereon. There are a plurality of sections 18 bearing each numeral 20 but each identical numeral 20 appears only on a differently colored section, so that the sections 18 are identified as 1 green, 1 red, 1 blue, 2 green, 2 blue etc. Extending through the surface of the gameboard 10 are a plurality of oil well holes or perforations 22, in this case three such holes or perforations 22 in each geographical section 18.

Figure 8:
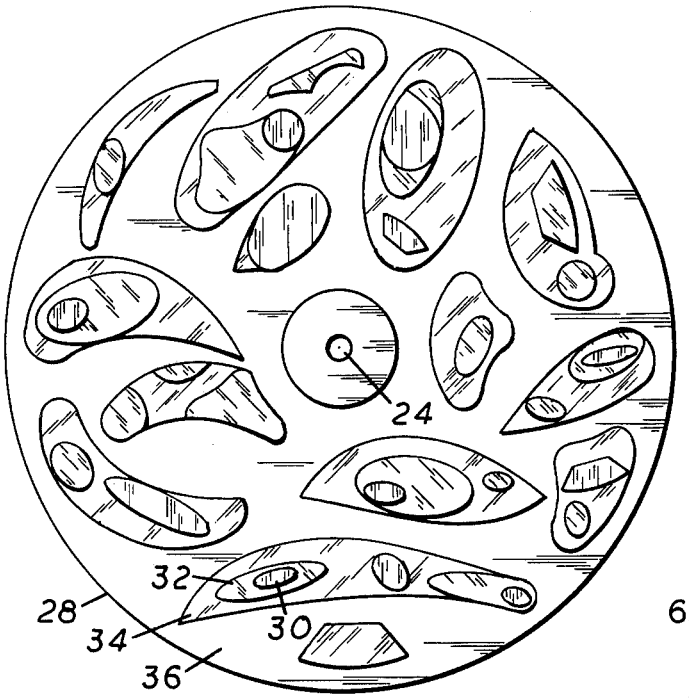
FIG. 8 is a plan view of the substratum oil field of the game board, such substratum also being shown in cross-section in FIGS. 2 and 12–15.
Figure 9:
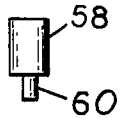
FIG. 9 is a side view of an oil barrel symbol.
Figure 10:
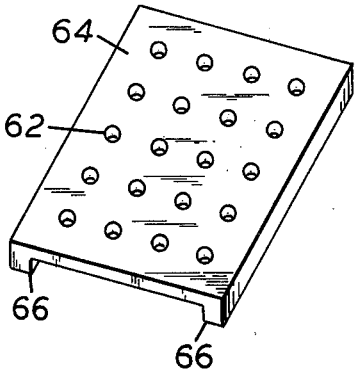
FIG. 10 is a perspective view of an oil barrel peg board retainer.
Figure 11:
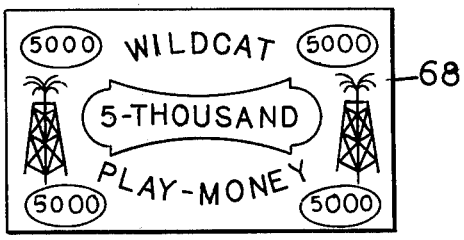
FIG. 11 is a plan view of a typical play money.
Figure 12:
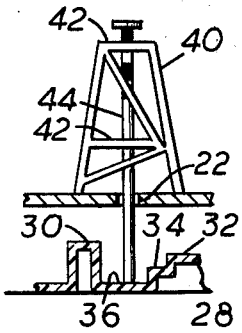
FIG. 12 is a sectional view of the game board and substratum oil field, showing a derrick and drill plunger at a dry well.
Figure 13:
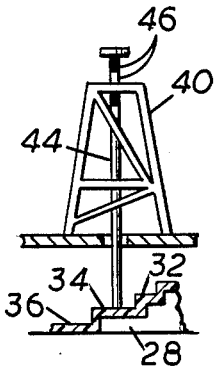
FIG. 13 is a similar view, showing a low value well.
Figure 14:
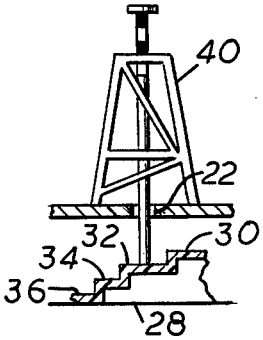
FIG. 14 is a similar view, showing an average value well.
Figure 15:
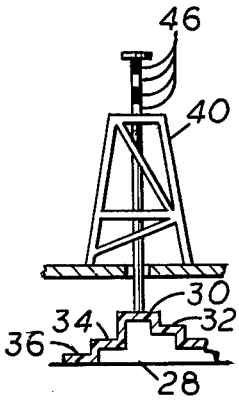
FIG. 15 is a similar view, showing a high value gusher well.

A multi-level oil field substratum 28 is rotatably supported within the three dimensional game board 10 by an integral shaft 24 extending upward through a central opening in the game board 10 and having a handle thimble 26 secured thereon of a diameter substantially larger than the central opening. This is shown in plan view in FIG. 8 and in cross section in FIGS. 2 and 12, 13, 14 and 15, there being four different levels 30, 32, 34 and 36. The top level 30 represents a high value gusher level, the second level 32 represents an average value level, the third level 34 represents a low value level, and the fourth level 36 represents a no value or dry well level.

A plurality of differently colored three dimensional derricks 40 are provided, each so constructed, as illustrated, with at least two derrick perforated platforms 42 through which an oil well drill or plunger 44 may be inserted when placed over a geographical section perforation or hole 22 to penetrate to a randomly selected substratum level thereunder. Each drill or plunger is provided with a suitable indicia 46 on its length to correspond with the depth to which the drill or plunger penetrates the game board surfaces to show which sub stratum level has been reached by the drill or plunger 44.

A spinning wheel 48 consisting of a pointer 50 rotatably mounted over the wheel surface 52 is provided, the wheel surface having colors and numerals corresponding to the colors and numerals of the geographical sub area 16, there being two sets of numerals and two colors in each guadrant 54, each of the four quadrants 54 being seperated from its adjacent quadrant by specially labeled sectors 55 labeled STAKE, FIRE, TAXES AND STRIKE.

A supply of exploration rights cards 56 are provided, each card 56 having one of the various numerals and colors as on the sections 18 and on the spinning wheel surface 52.

There is also provided a substantially three dimensional number of oil well barrels 58, each barrel having a peg 60 for insertion into a scoring peg board perforation 62 of a peg board 64 supported on runners 66, a sufficient supply of scoring peg boards 64 being provided for the various players.

Inasmuch as this game is to enable each player to become a millionaire or a pauper, a sufficient supply of wildcat play money is provided in suitable denominations, such as $1,000.00, $5,000.00, $10,000.00, etc., as desired.

RULES FOR PLAYING THE WILDCAT MILLIONAIRE OIL WELL DRILLING GAME

The purpose of the game is to become a millionaire by wildcat drilling for oil. Each player starts out with $150,000.00 play money 68 and a set of six derricks 40 at the beginning of the play. The sub stratum board 28 is spun by means of handle thimble 26 at the start of each game, so that the underground terrain at each sub area perforation 22 will be different each game.

Play is begun by spinning the pointer 50 on the selector wheel 48. When the pointer 50 selects a section 18 of land not already leased, the player may pay $25,000.00 to the public fund, and receives the exploration rights card 56 to the indicated section 18. He can select any of the uncovered holes 22 and drill for oil. This is done by placing a derrick 40 over the selected hole 22 and inserting the plunger 44 into the derrick 40 and allowing it to fall until it bottoms out. The plunger 44 will then indicate one of the following four conditions:

1. A gusher well 30 which will give a player an income of $15,000 from the fund at each subsequent turn.
2. A good well 32 which will give a player an income of $10,000 each subseqent turn.
3. A low yield well 34 which will give a player an income of $5,000 each subsequent turn.
4. A dry well 36 which receives nothing and the derrick must be removed.

In each case the player now has thee right to further explore the section 18 of land for which he has the exploration rights card 56. But he cannot further explore the section 18 of land until in his ensuing turns the spinner again stops on the land section 18 for which he owns the exploration rights 56. It will require a minimum of at least three spins of the indicator to drill all three holes 22 of a section of land should a player be so fortunate as to land on the same land section each time it is his turn.

Upon determining what a drilling operation yields, a player then receives an oil barrel 58 for each $5,000.00 of income derived from this well to be given each subsequent turn from the public fund. This barrel is placed in the holding peg board 64 so a player can tell at a glance how many barrels 58 of oil his wells are producing and how much the public fund is going to pay a player each turn, $5,000.00 for each barrel. Note: The only player who can drill for oil on any sub area or section 18 is the one who holds the exploration rights card 56.

Should the spinner stop and indicate a section 18 for which the player already owns the exploration rights 56, he will receive double his normal income from all his producing wells in that section, if any; if no well exists, only his normal income from his other producing wells, if any. In both cases, the player is entitled to another turn (maximum of two turns). If the player again lands on a section for which he holds the exploration rights 56, he receives his regular income from the producing wells on that section 18, if any; if none, no income.

If a player's spin indicates a section 18 for which he owns the exploration rights 56 and not all the holes 22 have been drilled, he then must choose as to whether to take double the income from this section or forfeit this income and pay $25,000.00 to the public fund for the right to drill another well. All other income is not disturbed.

Should the pointer 50 select a section 18 owned by another player, and the land section has a producing well, spinner must purchase that player's oil production of all producing wells, determined by number of barrels. Should the pointer 50 indicate a section 18 owned by another player, but not having a producing well, nothing is purchased from the owner.

Should a player be unable to meet his obligations, then he may do one of the following to raise capital:

1. Remove a well from a section 18 and return the barrels indicating the income from his barrel board to the public fund. For this a player receives $5,000.00 from the public fund.
2. If a player wishes to remove a well to meet his obligation, he must do so from the section with the least amount of producing wells.
3. A player may sell to the highest bidder the exploration rights card 56 which he owns, even if there are producing wells on it. If there are no takers, then a player must sell the exploration rights back to the public fund if he cannot negotiate a sale for needed capital and requires further money. The player receives $5,000.00 for each producing well on the returned section and $25,000.00 for the section exploration rights card. If there are no producing wells on the section 18 being returned to the public fund, then a player only receives $10,000.00 for the section exploration rights card 56.
4. Should a player be unable to come up with the monies required, he can then declare bankruptcy and his entire holdings go up for public auction. The highest bidder then pays that money to the player which the backrupt player owes and cannot pay. If the highest bidder is the player to whom the bankrupt player owes the money, then the money this bidder pays go to the public fund. When any of the above is exercised the bankrupt player is out of the game. If no one bids on the holdings of the player going into bankruptcy, then that player's holdings are all turned back to the public fund.

Penalties:

1. TAXES—A player pays public fund $25,000 and collects no income.
2. FIRE—Player pays 10,000 per each producing well to the public fund and receives no income.
3. STRIKE—Player receives no income from his wells.

Bonus:

4. STAKE—Entitles player to receive $25,000 from the public fund, plus and additional spin.

Obviously, the above example of playing with the game board is only one way of playing, and many other rules could be formulated, as desired.

ABSTRACT OF THE DRAWINGS

In the drawings, like numbers refer to like parts, and for the purposes of explication, set forth below are the numbered parts of the WILDCAT OIL WELL DRILLING GAME of this invention:

10 three dimensional game board
12 geographical area

14 sub area section boundary lines
16 sub area section colored surfaces
18 section
20 numrals on 18
22 drilling perforations or holes
24 sub stratum shaft
26 handle thimble on 24
28 oil field sub stratum
30 gusher level
34 low value level
36 dry well
40 derrick
42 derrick platforms
44 drill or plunger
46 depth indications on plunger 44
48 chance sinning wheel
50 spinner pointer
52 wheel surface
54 wheel quadrant
55 sectors between 54
56 exploration rights cards
58 oil barrel symbol
60 barrel peg
62 perforations in 64
64 peg board
66 runners of 64
68 play money Although this invention has been described in considerable detail, such description is intended as being illustrative rather than limiting, since the invention may be variously embodied, and the scope of the invention is to be determined as claimed.

Having thus set forth and disclosed the nature of this invention, what is claimed is:

1. A wildcat oil well drilling game comprising a three dimensional game board (10) having a representation of a geographical oil field area (12) thereon, said game board (10) having a three dimensional oil field substratum means (28) mounted for rotation about a fixed vertical axis in said game board therewithin beneath its top surface (16), said oil substratum means (28) having a multiplicity of various levels (30–36) representing different quantities or absence of drillable amounts of oil, said game board (10) having a plurality of identified geographical sections (18) indicated on said top surface, each section (18) having a plurality of well drilling holes (22) therethrough, beneath which said oil field substratum means (28) may be rotated to place different substratum oil field levels (30–36) randomly beneath said well drilling holes (22) of said various geographical sections (18) of said game board, a plurality of three dimensional visually distinguishable drilling derricks (40) placable over said game board drilling holes (22), and a plurality of derrick drilling plungers (44) adapted to be inserted through derricks (40) placed on said game board (10), said drilling plungers (44) each having indicia thereon indicating the depth the said plunger (44) is inserted, identifying the substratum level it has reached when inserted and chance means (48) for selecting the section (18) where a player may locate his derrick (40), said chance means comprising a chance spinner (50) and a wheel (52) having indicia (54, 55) corresponding to the indicia (16, 20) on said sections (18).

2. The game of claim 1, and a plurality of oil barrel symbols (58) having peg means (60) extending from one surface thereof, and a plurality of player peg boards (64) for receiving said peg means of said oil barrel symbols therein.

3. The game of claim 2, and plurality of play money representations of various denominations.

4. The game of claim 1, and a plurality of player identified exploration rights means (56).

5. The game of claim 1, and a plurality of oil barrel symbols (58) having peg means (60) extending from one surface thereof, a plurality of player peg boards (64) for receiving said peg means of said oil barrel symbols (58) therein, a plurality of player identified exploration rights means (56), and a plurality of play money (68) representations of various denominations for buying and selling in the play of the game.

* * * * *